United States Patent [19]

Bolinsky et al.

[11] Patent Number: 4,557,699

[45] Date of Patent: Dec. 10, 1985

[54] METHOD OF VERIFYING THE OPERABILITY OF SOCKETS IN A KINESCOPE AGING LINE

[75] Inventors: Henry E. Bolinsky; Edward J. Klovensky, both of Lackawanna County, Pa.

[73] Assignee: RCA Corporation, Princeton, N.J.

[21] Appl. No.: 598,731

[22] Filed: Apr. 10, 1984

[51] Int. Cl.[4] ..... H01J 9/42

[52] U.S. Cl. ..... 445/3; 445/6

[58] Field of Search ..... 445/3, 5, 6, 62, 63

[56] References Cited

U.S. PATENT DOCUMENTS

| | | | |
|---|---|---|---|
| 1,983,668 | 12/1934 | Jones et al. | 250/27.5 |
| 4,038,616 | 7/1977 | Ball | 445/3 |
| 4,066,311 | 1/1978 | Poulson | 316/28 |
| 4,125,306 | 11/1978 | Coble | 316/1 |
| 4,163,308 | 8/1979 | Tawa et al. | 445/3 |
| 4,445,872 | 5/1984 | Ottos | 445/3 |

*Primary Examiner*—Kenneth J. Ramsey
*Assistant Examiner*—Kurt Rowan
*Attorney, Agent, or Firm*—D. H. Irlbeck; L. L. Hallacher; T. H. Magee

[57] ABSTRACT

The operability of the connecting sockets of a kinescope aging line is verified by applying the aging voltages through ammeters. The current plots are side-by-side whereby low current plots for both voltages indicate an empty carrier while a low current for only one of the plots indicates a defective socket.

4 Claims, 3 Drawing Figures

METHOD OF VERIFYING THE OPERABILITY OF SOCKETS IN A KINESCOPE AGING LINE

BACKGROUND OF THE INVENTION

This invention relates generally to the production of kinescopes and particularly to the verification of the operability of the conveyor line sockets and wiring harnesses used to apply aging voltages to kinescopes.

One of the final steps in the production of kinescopes for color television receivers is that of aging. During the aging process, the filament voltage is applied to the filament and the G2 voltage is applied to the G2 electrode of the kinescope for a set period of time, typically 30 to 90 minutes. The activation of the cathode during the aging process causes the cathode to emit electrons to stabilize the cathode and to enhance the uniformity of the cathodes of the various tubes. Additionally, the electrons emitted from the cathode bombard the G2 and other electrodes thus causing out-gassing to stabilize these electrodes.

Typically, the aging is effected by placing the completed kinescopes on carriers moving along a conveyor line. Each of the carriers includes a socket which is connected to the electrical connector pins of the kinescopes. The aging voltages are applied to the socket by a wiring harness which is electrically coupled to busbars along which the carriers are moved. The bus bars are voltage biased to the aging voltages. Thus the speed and length of the conveyor line are selected to cause each of the completed kinescopes to move along the busbars for the length of time required for complete aging of the kinescope.

Such conveyor line aging is ordinarily satisfactory for the purposes intended. However, problems sometimes arise because the sockets are manually connected to and disconnected from the tubes and also because the sockets are very frequently connected and disconnected. Accordingly, there is a high probability of a socket or wiring harness being damaged by the frequency use. A defective socket or wiring harness can prevent one or more of the operating voltages from being applied to the kinescope and, when this happens, the tube is not properly aged. In the absence of prompt detection of a defective socket, a large number of tubes can be continued through the production cycle without being properly aged.

For these reasons, there is a need for a method for automatically verifying the operability of all the sockets and wiring harnesses used in a kinescope aging line. The instant invention fulfills this long felt need.

SUMMARY

A method of verifying the operability of the connecting sockets in a kinescope aging conveyor line, in which the kinescopes move along bus bars on carriers and the bus bars apply operational voltages to the kinescopes through the sockets of the carriers, includes the steps of applying the operational voltages to special bus bar sections through individual ammeters and pen plotters to plot current flow for each of the operational voltages. The pen plotters are started and the identification of the first carrier to reach the special bus bar sections after the start of the pen plotters is recorded. The plotters are arranged such that the pen plots for each carrier are adjacent whereby the validity of each operational voltage is readily verified by visual inspection of the plots.

DETAILED DESCRIPTION

Figure 1:
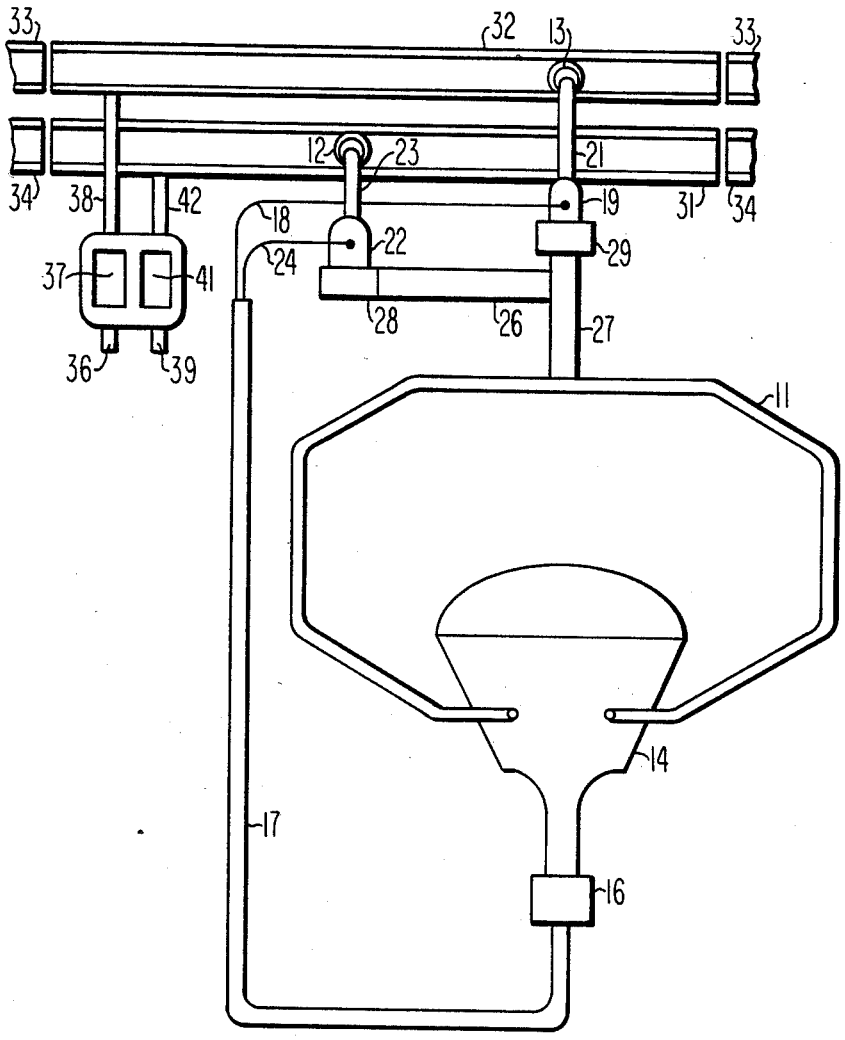
FIG. 1 is a preferred embodiment.

In FIG. 1, a carrier 11 is suspended from conductive rollers 12 and 13. A kinescope 14 is carried by the carrier 11. A socket 16, which is a permanent part of the carrier 11, is coupled to the electrical connector pins of the kinescope. The socket 16 is coupled by a wiring harness 17 to the rollers 12 and 13. A portion 18, of the harness 17, is electrically connected to the roller 13 by a coupling 19 and a conductive suspension bar 21. Similarly, another portion 24 of the harness 17 is coupled to the roller 12 by a coupling 22 and a conductive suspension bar 23. The rollers 12 and 13 are physcially attached to the carrier 11 and to each other by appropriate mechanical members 26 and 27. The coupling 22 is electrically insulated from the member 26 by an insulator 28. Similarly, the coupling 19 is electrically insulated from the support member 27 by an insulator 29.

The roller 12 runs in a conductive bus bar section 31 and the roller 13 rides in a conductive bus bar section 32. The bus bar sections 31 and 32 are special bus bar sections and are electrically isolated from the bus bars 33 and 34 which form the main portion of the conveyor line. The filament voltage used to age the kinescope is applied to the bus bar section 32 by an input cable 36 through an ammeter 37 and a connecting cable 38. Similarly, the G2 voltage is applied to the bus bar section 31 by an input cable 39 through an ammeter 41 and a connecting cable 42. The input cables 36 and 39 can also be directly coupled to the bus bars 33 and 34, respectively. Pen plotters of known type, such as Model number A602C-10-MXBL-MPXR-43 available from Esterline Angus are associated with each of the ammeters 37 and 41. Accordingly, when the conductive rollers 12 and 13 are in contact with the special bus bar sections 31 and 32, the filament and G2 voltages are applied to the kinescope 14 through the ammeters 37 and 41. The pen plotters plot the current flow and the proper flow indicates that a tube is in the carrier 11 and that the socket 16 and wiring harness 17 are operative and the kinescope 14 is being properly aged.

Typically in operation, the rollers 12 and 13 are in contact with the bus bars 33 and 34 and the ammeters 37 and 41 have no effect and the current flow to the kinescope 14 is not monitored. However, when the rollers 12 and 13 come into contact with the bus bar sections 31 and 32 the filament and G2 voltages are applied to the kinescope through the ammeters 37 and 41 to monitor the current flow to the kinescope 14. It should be noted that as shown in FIG. 1, the rollers 12 and 13 would appear to reach the bus bars sections 31 and 32 at different times. This is for convenience of illustration only as the rollers are coupled to the carrier 14 in a manner such that both rollers simultaneously reach and leave the respective bus bar sections 31 and 32 and the monitoring of current flow to the socket 16 simultaneously begins and ends for both of the bus bar sections 31 and 32.

Figure 2A:
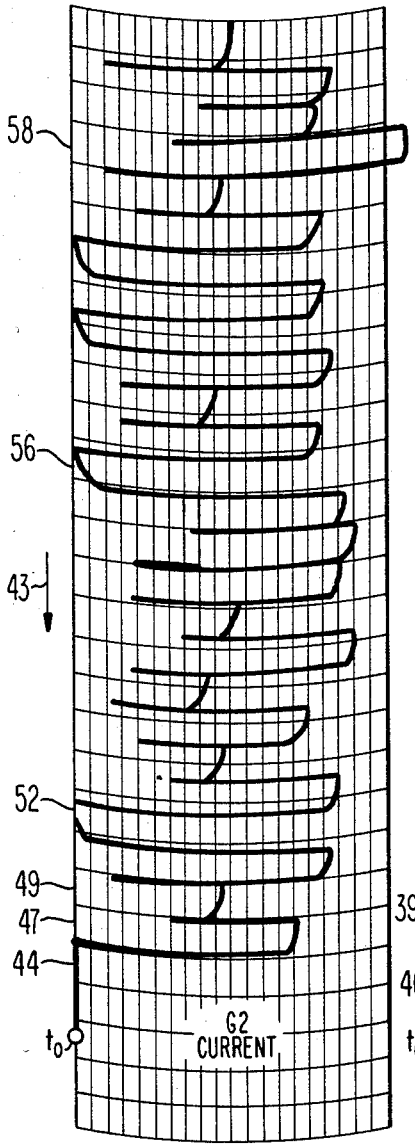
FIGS. 2*a* and 2*b* show how the defective sockets are identified utilizing the claimed invention.
Figure 2B:
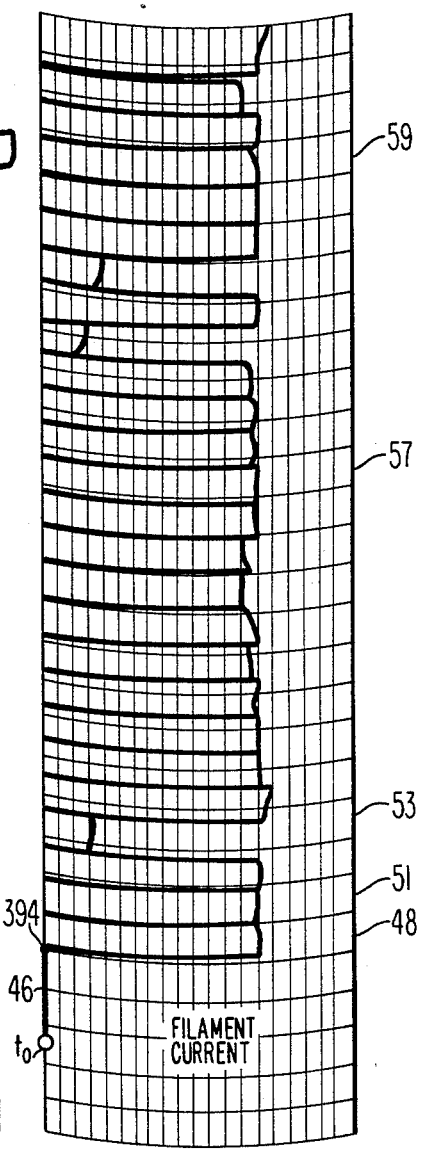

FIGS. 2*a* and 2*b* illustrate how the application of the filament and G2 voltages to the kinescope 14 through the ammeters 37 and 41 is useful in identifying inoperative or damaged sockets 16 or wiring harnesses 17. FIG. 2*a* shows the plot of the G2 current for a plurality of kinescopes and FIG. 2*b* shows the plot of the filament current for the same set of kinescopes. Initially, the current recorders are provided with a strip of paper such as that shown in FIG. 2*a* and 2*b* and the charts begin to linearly move through the pen recorder at a time t0 in a direction indicated by the arrow 43. The conveyor system includes a large number, such as 400 or 500, of the carriers 11 which are continually drawn along the bus bars 33 and 34 by a chain and drive mechanism, not shown, which is well known in the art. Each of the carriers 11 is individually identified, for example by sequential numbering. The identification of the first carrier to reach the special bus bar sections 31 and 32 after the chart recorders are turned on is recorded by the operator. No current flows through the ammeters 37 and 41 until the rollers 12 and 13 are in contact with the special bus bar sections 31 and 32. Thus, in FIGS. 2*a* and 2*b* no current is recorded as indicated by the straight portions 44 and 46 of the two pen plots. When the first carrier, such as number 394, reaches the bus bar sections 31 and 32, current flows and the plot 47 of the G2 current in FIG. 2*a* is drawn and the plot 48 of the filament current in FIG. 2*b* is drawn. These two current plots show that the aging voltages are being applied to the kinescope 14, and the socket 16 and wiring harness 17 which are associated with the carrier are operating properly. When the first carrier moves off of the special bus sections 31 and 32, the next successive carrier moves onto the bus sections and the plots at 49 and 51 are obtained. Accordingly, the bus sections 31 and 32 are dimensioned so that only one of the carriers 11 is on the bus bar sections 31 and 32 at a given time. The current level of plot 49 is lower than the plot 47. However, this is a function of the kinescope and is normal. Also, the currents are being monitored rather than measured and, therefore, the exact level of the current is not important. When the fourth carrier reaches the bus sections 31 and 32, the plots 52 and 53 in FIGS. 2*a* and 2*b*, respectively, show very low filament current flow and no G2 current flow. The current plots 52 and 53 are indicative of the absence of a kinescope 14 from the carrier 11 and an empty carrier has passed across the bus sections 31 and 32 and no corrective steps need to be taken. When the 14th carrier reaches the bus sections 31 and 32, no current plot is present at 56 for the G2 current in FIG. 2*a* while a current plot is present at 57 in FIG. 2*b* for the filament current. This indicates that the kinescope 14 is not receiving the proper G2 current and, accordingly, either the socket 16 or harness 17 is probably defective and should be removed from the line for testing and possible repair. In FIG. 2*a*, G2 current plot 58 shows a very high G2 current while the filament current plot 59 of FIG. 2*b* is normal. This indicates a shorted socket 16 and warrants repairing the socket.

The plots shown in FIGS. 2*a* and 2*b* are arranged and aligned in the system such that the plots for the two currents are adjacent for every carrier. Accordingly, the defective carriers are immediately identifiable by visual plots. Additionally, empty carriers are readily identified because very low or no current readings are received from both the plots for such carriers. Additionally, simply by identifying the first carrier to reach the bus bar sections 31 and 32 when the system is turned on, carriers having defective sockets or harnesses are easily identified by visual inspection of the charts.

We claim:

1. A method of verifying the operability of the connecting sockets in a kinescope aging conveyor line wherein the kinescopes are moved along bus bars on carriers and the bus bars apply operational voltages to the kinescopes through the sockets of the carriers comprising the steps of:

applying said operational voltages to special bus bar sections through individual ammeters, said special bus bar sections being sections along said bus bars but electrically isolated therefrom, each ammeter being associated with a pen plotter to plot current flow for each of said operational voltages;

individually identifying every carrier;

starting said pen plotters and recording the identification of the first carrier to reach said special bus bar sections after the start of said pen plotters; and arranging said plotters such that the pen plots for each carrier are adjacent whereby the validity of each operational voltage is readily verified by visual inspection of the current plots.

2. The method of claim 1 further including the step of dimensioning the special sections of bus bars such that only one carrier is on the special sections at a time.

3. The method of claim 2 wherein said pen plots are made on linearly moving charts.

4. The method of claim 3 wherein the operational voltages are the filament voltage and the G2 voltage.

* * * * *